US010060079B2

(12) United States Patent
Wilson et al.

(10) Patent No.: US 10,060,079 B2
(45) Date of Patent: Aug. 28, 2018

(54) MAT

(71) Applicant: Incubator Industries, L.P., Beaumont, TX (US)

(72) Inventors: Andrew Gray Wilson, Beaumont, TX (US); Herbert Orain Tubbs, Beaumont, TX (US)

(73) Assignee: MedEncentive, LLC, Oklahoma City, OK (US)

( * ) Notice: Subject to any disclaimer, the term of this patent is extended or adjusted under 35 U.S.C. 154(b) by 0 days.

(21) Appl. No.: 15/266,263

(22) Filed: Sep. 15, 2016

(65) Prior Publication Data

US 2017/0073903 A1 Mar. 16, 2017

Related U.S. Application Data

(60) Provisional application No. 62/218,877, filed on Sep. 15, 2015.

(51) Int. Cl.

| | |
|---|---|
| ***E01C 9/08*** | (2006.01) |
| ***B66C 1/66*** | (2006.01) |
| ***B66C 23/78*** | (2006.01) |
| ***E04B 5/02*** | (2006.01) |

(52) U.S. Cl.

CPC ..... *E01C 9/086* (2013.01); *B66C 1/66* (2013.01); *B66C 23/78* (2013.01); *E04B 5/02* (2013.01); *E01C 2201/167* (2013.01)

(58) Field of Classification Search

USPC ..... 52/125.2, 125.3, 125.4, 125.5; 404/34, 404/35, 40, 86

See application file for complete search history.

(56) References Cited

U.S. PATENT DOCUMENTS

| | | | | | |
|---|---|---|---|---|---|
| 188,216 | A | * | 3/1877 | Deutsch | F16K 5/0605 137/625.22 |
| 1,177,231 | A | * | 3/1916 | Carter | E01C 5/005 404/40 |
| 2,231,780 | A | * | 2/1941 | Swenson | E04F 15/08 404/34 |
| 2,736,248 | A | * | 2/1956 | Greulich | E01C 9/083 404/36 |
| 3,213,768 | A | * | 10/1965 | Jensen | E01C 5/085 14/73 |
| 3,883,170 | A | * | 5/1975 | Fricker | B66C 1/666 24/600.7 |

(Continued)

OTHER PUBLICATIONS

"Crane Mat", U.S. Appl. No. 14/730,060, filed Jun. 3, 2015, unpublished, 22 pages.

*Primary Examiner* — Thomas B Will
*Assistant Examiner* — Katherine J Chu
(74) *Attorney, Agent, or Firm* — Lawrence F. Grable, P.L.L.C.

(57) ABSTRACT

A movable mat is formed from a plurality of elongate beams arranged in side-by-side relationship. The mat features a recessed area formed from a pair of adjacent notched beams. An elongate connector passes through both of the adjacent notched beams at the recessed area. A portion of the connector within the notch is surrounded by a rigid sleeve. At least one pocket is formed in an upper surface of one of the beams. A rotatable coupler is situated within the pocket. The mat may be moved by attaching lifting equipment to the connector at one of the recesses or to the coupler. To form a flooring system, a plurality of mats may be arranged adjacent each other on a surface of the ground.

12 Claims, 12 Drawing Sheets

(56) References Cited

U.S. PATENT DOCUMENTS 4,367,892 A * 1/1983 Holt ..... B66C 1/666 294/82.31
4,600,336 A 7/1986 Waller
4,615,554 A * 10/1986 Schilla ..... B66C 1/666 294/89
4,703,595 A * 11/1987 Zipf ..... B66C 1/666 294/89
4,932,178 A * 6/1990 Mozingo ..... E01D 2/00 52/223.7
5,155,954 A * 10/1992 Roire ..... E04G 15/04 249/190
5,201,467 A 4/1993 Kennel et al.
5,244,243 A * 9/1993 Grayson ..... B66C 1/666 294/82.35
5,580,115 A * 12/1996 Jessen ..... B66C 1/666 294/82.31
5,601,900 A 2/1997 Doscher
5,807,021 A 9/1998 Aaron
6,007,271 A 12/1999 Cole et al.
7,934,885 B2 5/2011 Fournier
7,945,980 B2 5/2011 Zylman
8,172,289 B2 * 5/2012 MacKay Sim ..... B66C 1/666 294/82.35
9,315,949 B1 * 4/2016 Penland, Jr. ..... E01C 5/006
2005/0063780 A1 * 3/2005 Thorne ..... E01C 9/086 404/41
2007/0056228 A1 * 3/2007 Penland, Sr. ..... E01C 5/14 52/177
2008/0292397 A1 11/2008 Farney et al.
2014/0186573 A1 * 7/2014 Tubbs ..... B32B 7/08 428/99
2014/0199119 A1 * 7/2014 Stasiewich ..... E01C 9/08 404/41
2016/0235234 A1 8/2016 Tubbs

* cited by examiner

MAT

CROSS REFERENCE TO RELATED APPLICATION

This application claims the benefit of U.S. Provisional Patent Application Ser. No. 62/218,877 filed on Sep. 15, 2015, the entire contents of which are incorporated herein by reference.

FIELD

The invention relates to tools and systems for supporting heavy equipment on movable mats.

SUMMARY

A mat is formed from a plurality of elongate beams arranged in side-by-side relationship. Each beam has a pair of opposed side surfaces and a pair of opposed upper and lower surfaces. The elongate beams include a pair of adjacent notched beams. Each notched beam has a notch formed in no more than a portion of its upper surface. The notches are disposed in contiguous relationship to form a recess within the mat.

The mat is also formed from a pair of opposed first and second sides and a pair of opposed upper and lower sides. The opposed first and second sides and the opposed upper and lower sides are formed from a plurality of elongate beams arranged in side-by-side relationship. At least one of the beams has a pocket formed in the beam on the upper side of the mat. A rotatable coupler is situated within the pocket. The coupler has a pivot point, an eye, and at least one lever.

The mat is also formed from a plurality of elongate beams arranged in side-by-side relationship. At least two adjacent beams have contiguous notches formed in the ends of the beams. A plurality of connectors extend transversely through each beam. At least one of the connectors extends through the contiguous notches, and a rigid sleeve is positioned within the notches and surrounding the connector.

DETAILED DESCRIPTION

Ground cover mats formed from wooden timbers are often used at job sites to provide a surface for supporting heavy equipment. The mats protect the ground and prevent the equipment from getting stuck. Since the mats are often heavy, it is advantageous for the mats to have lifting mechanisms that enable the mats to be lifted and moved into place by equipment, such as a hoist or a crane.

With reference to FIGS. 1-5, the mat 10 of the present invention comprises a plurality of elongate beams 12 positioned side-by-side. Preferably, the beams 12 are made from a strong and durable material such as wood. However, the beams may be made of any suitable material, including metal or plastic. If wood, beams formed from southern yellow pine and/or oak are preferred. The timbers may be treated with preservative chemicals and processes to improve the longevity of the mats for ground contact applications and to protect the mats against weather conditions.

Figure 1:
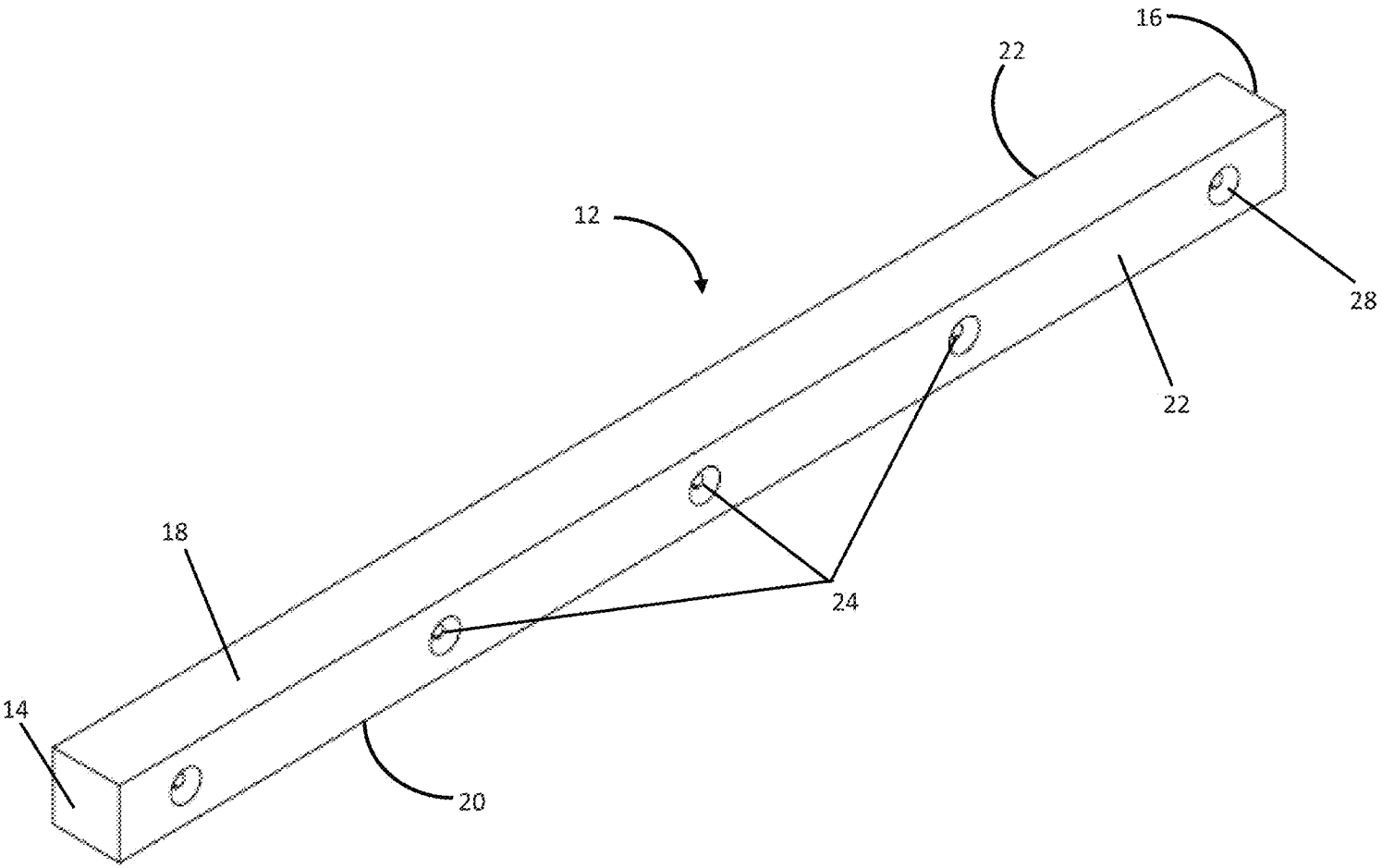
FIG. 1 is a perspective view of an elongate beam.

As shown in FIG. 1, the beams 12 have a first end 14 and a second end 16. Additionally, the beams 12 have an upper surface 18, a lower surface 20, and a pair of opposed side surfaces 22. The beams 12 are characterized by a plurality of bores 24 extending transversely through the beams 12 between the opposed side surfaces 22. Although five bores 24 are shown in FIG. 1, any suitable number of bores 24 may be used. The bores 24 on adjacent beams 12 may be aligned to form a passage (not shown) through the mat 10. The passage provides clearance so that a plurality of elongate connectors 26 (FIG. 4) can pass transversely through the aligned bores 24 to secure the beams 12. A countersunk area 28 may be formed at each end of each bore 24, so that the elongate connectors 26 may be fully recessed within the beams 12. Recessing the connectors reduces the risk that workers or their clothes will get snagged by connectors projecting outside the beams.

Figure 4:
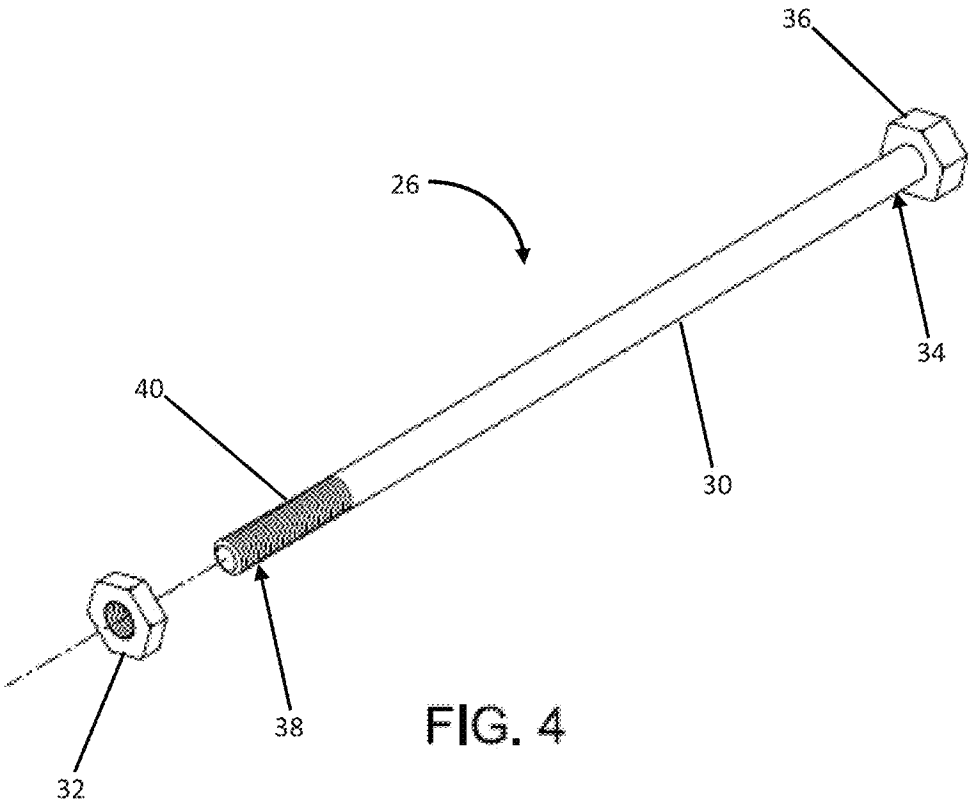
FIG. 4 is a perspective view of a tensioning bolt and a nut.

With reference to FIG. 4, the connectors 26 are made from a sturdy material such as metal or plastic. Preferably, the connectors 26 are rigid rods formed from steel.

The connectors 26 are preferably releasably tightened to control the fit between adjacent beams 12. In the embodiment of FIG. 4, the connector 26 comprises a tensioning bolt 30 and a nut 32. The tensioning bolt 30 is characterized by a first end 34 having a bolt head 36 and a second end 38 having a threaded portion 40. The nut 32 may be threaded onto the threaded portion 40 of the tensioning bolt 30 to releasably tighten the connector 26.

Alternative to the embodiment of FIG. 4, the connector 26 may comprise a threaded rod (not shown) having a second nut (not shown). The second nut may be threaded onto the rod and welded to the rod near an end of the rod. Similar to the bolt head 36 of FIG. 4, the welded nut provides a shoulder (not shown) to limit movement of the rod through the aligned bores.

Figure 5:
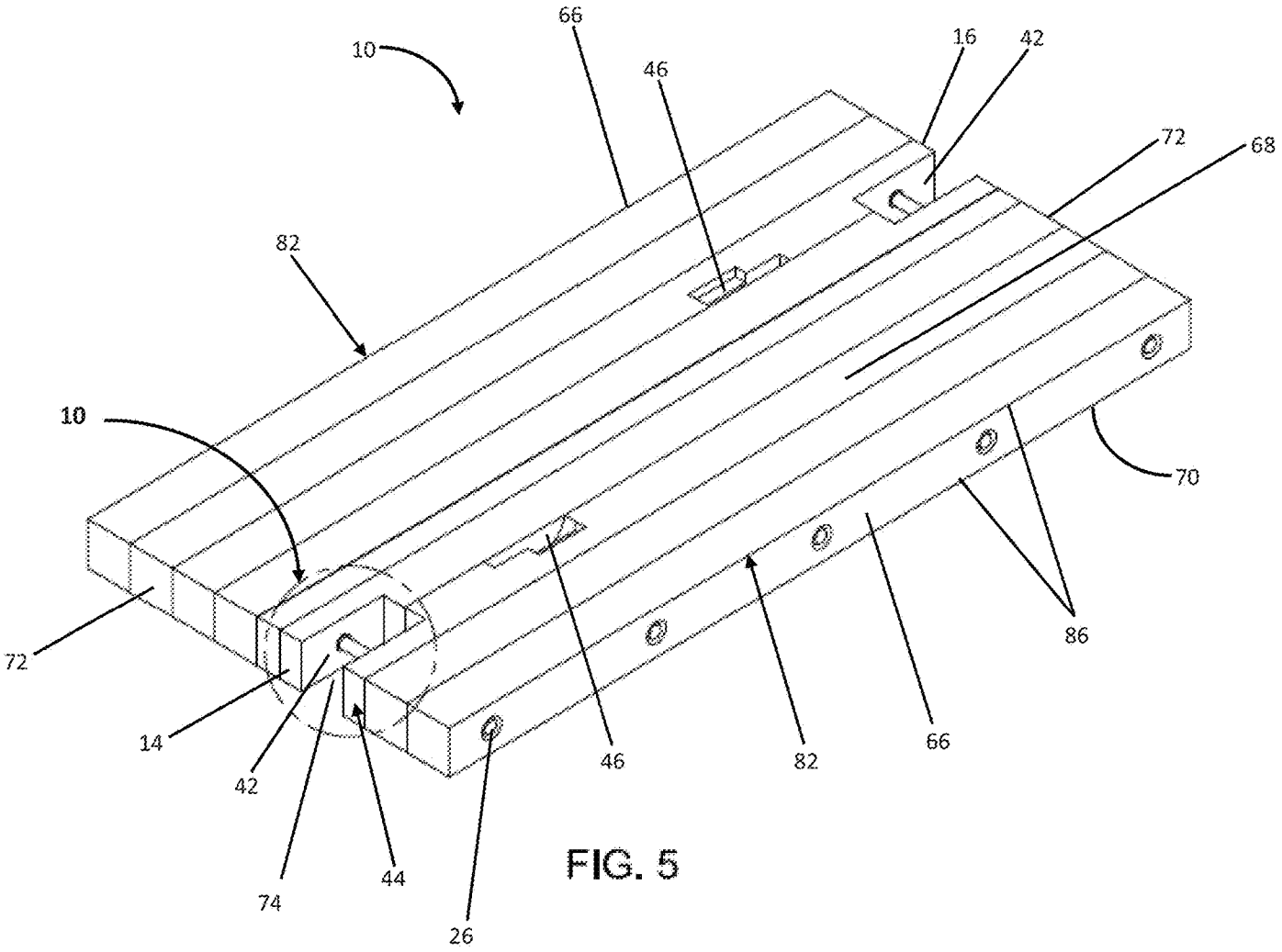
FIG. 5 is a perspective view of a mat formed from the beams of FIGS. 1-3.

Turning to FIG. 5, the mat 10 includes a plurality of notches 42. Two of the plurality of notches 42 are contiguous with each of the first ends 14 of a pair of adjacent beams 12, and another two of the plurality of notches 42 are contiguous with each of the second ends 16 of a different pair of adjacent beams 12. The notches 42 in the second ends 16 of the beams 12 are identical in size and shape to the notches 42 in the first ends 14 of the beams 12.

Figure 2:
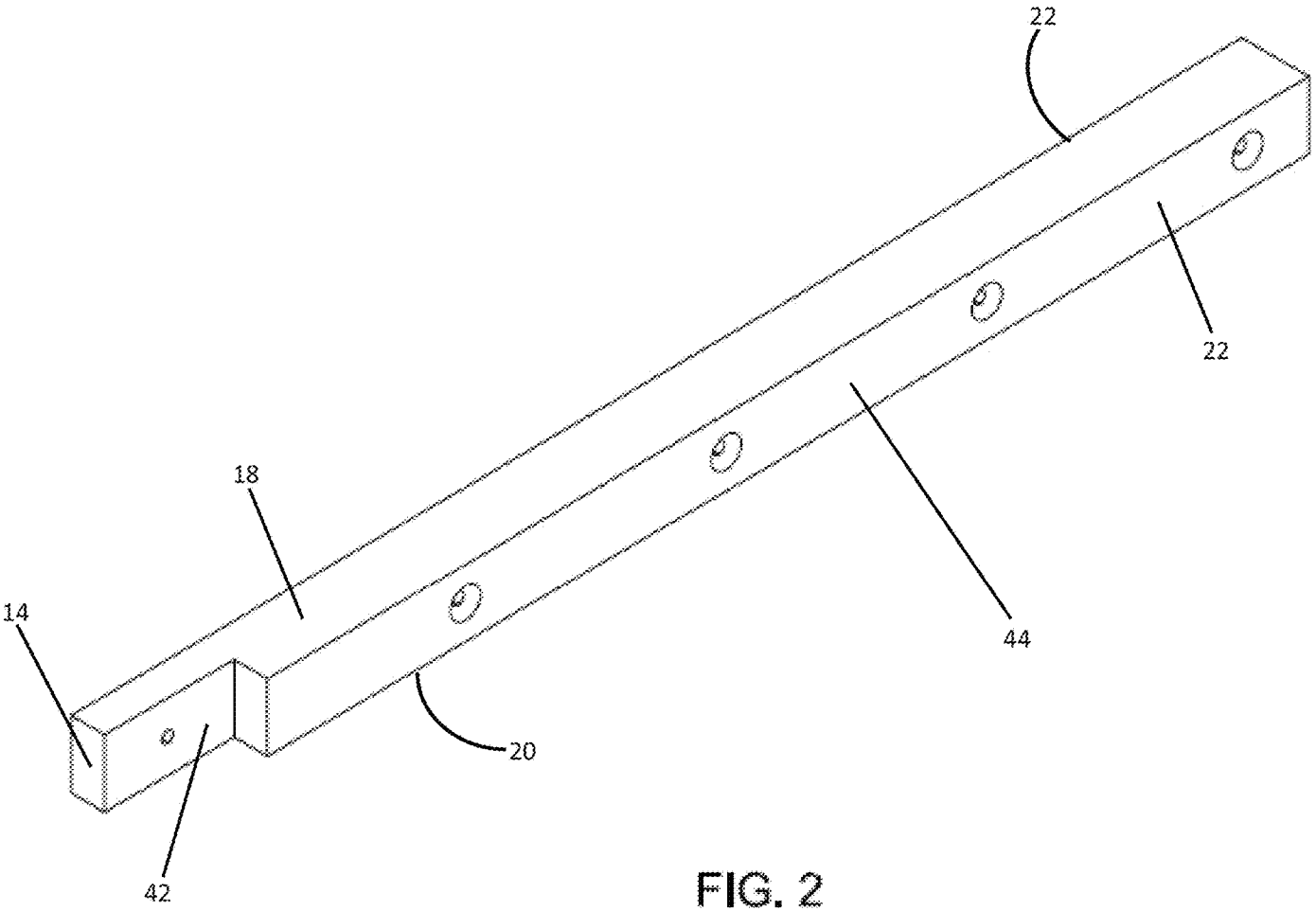
FIG. 2 is a perspective view of an elongate beam having a notch formed in a first end of the beam.

Shown in FIG. 2 is a notched beam 44 having the notch 42 formed contiguous with the first end 14 of the beam 12. The notches 42 may extend from the upper surface 18 of the beam 12 to the lower surface 20 of the beam 12. The notch 42 is formed in only a portion of the upper surface 18 of the beam 12. Preferably, the width of the notch 42 is approximately one-half the width of the beam 12. Also, the notch 42 preferably extends through one of the pair of opposed side surfaces 22.

Figure 3:
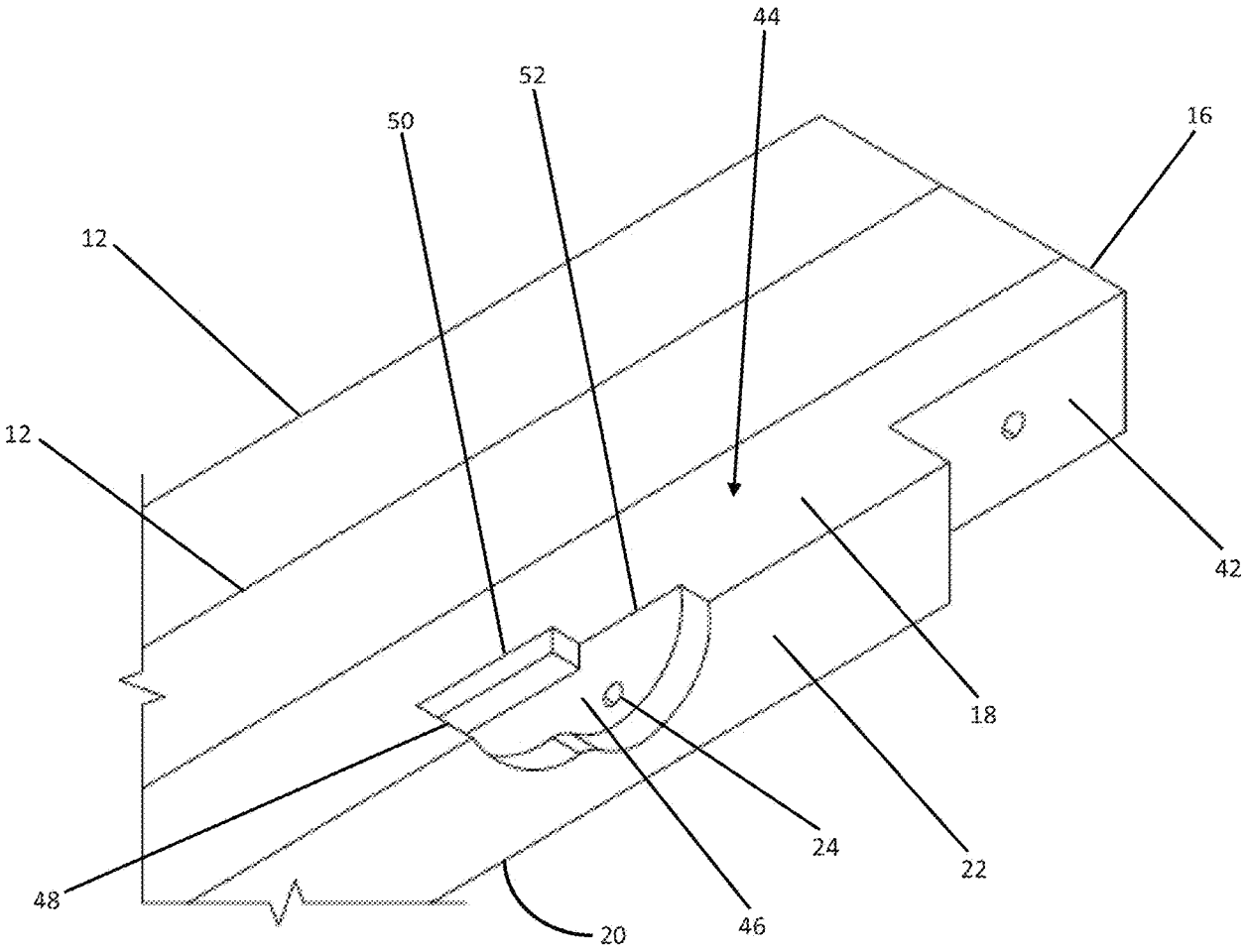
FIG. 3 is an enlarged perspective view of three adjacent elongate beams, in which one of the beams has a notch formed in the second end of the beam and a pocket formed in an upper surface of the beam.

As shown in FIGS. 3 and 5, at least one of the beams 12 is characterized by at least one pocket 46 formed in the upper surface 18 of the beam 12. In FIG. 3, the pocket 46 is formed near the second end 16 of the beam 12 having the notch 42. However, the pocket 46 may be formed in any beam 12, notched or unnotched. Likewise, the pocket 46 need not be formed at the end of the beam, and may be formed at any suitable position along the upper surface 18.

As best shown in FIG. 3, the pocket 46 preferably extends through at least one of the beam's opposed side surfaces 22. Preferably, the pocket 46 extends through the beam's upper surface 18 to form a pocket opening 48. As shown in FIG. 3, the pocket 46 preferably does not extend through the beam's lower surface 20. However, in another embodiment, the pocket 46 may extend through the beam's lower surface 20 to form a lower pocket opening (not shown). The pocket 46 may be formed around one of the plurality of bores 24 in the beam 12. The elongate connector 26 positioned within the bore 24 transverses any pocket 46 that surrounds it.

Continuing with FIG. 3, the pocket 46 is characterized by a wide section 50 and a narrow section 52. Both the wide section 50 and the narrow section 52 extend through the pocket opening 48. However, the wide section 50 preferably extends through only a portion of the depth of the pocket 46. Also preferably, the wide section 50 is wide enough to allow finger access to the pocket 46 at the pocket opening 48.

Figure 12:
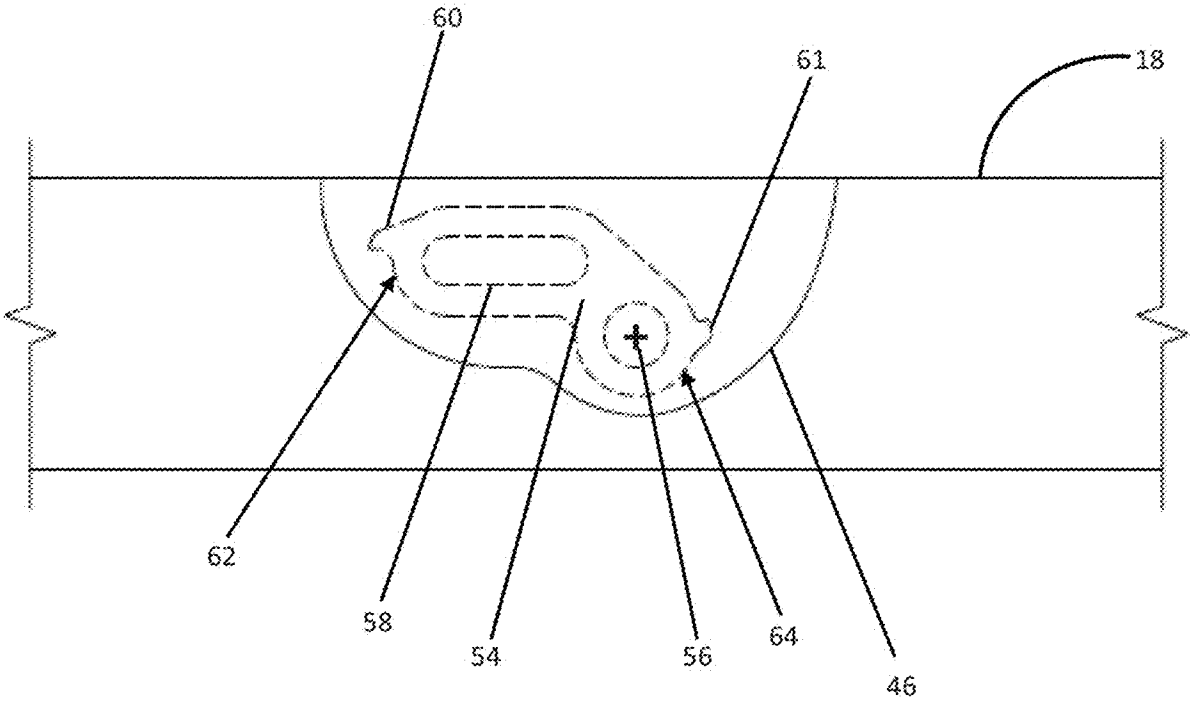
FIG. 12 is a cross-sectional view of the pocket formed in the mat of FIG. 5, showing a coupler in a hidden position within the pocket.

With reference to FIG. 12, a coupler 54 is shown within the pocket 46. The coupler 54 is a substantially flat, elongate member formed from a sturdy material, such as metal or plastic. Preferably, the coupler 54 is formed from steel. At least two openings are formed in the coupler 54, preferably by punching. One of these openings is a pivot point 56 formed intermediate the coupler's ends. The other is an eye 58 formed adjacent one of the coupler's ends.

Continuing with FIG. 12, the coupler 54 includes a lever 60. The lever 60 is an appendage preferably situated near one of the coupler's ends. Preferably, the lever 60 is situated on a same side 62 of the pivot point 56 as the eye 58, and a second lever 61 is situated on an opposite side 64 of the pivot point 56 as the eye 58.

The coupler 54 may be moved from a hidden position shown in FIGS. 5 and 12 to an exposed position (FIG. 13) by rotating the coupler 54 in a first direction about the pivot point 56. Conversely, the coupler 54 may be retracted from an exposed position to a hidden position by rotating the coupler 54 in a second direction about the pivot point 56.

In FIG. 12, the coupler 54 is shown in a hidden position within the pocket 46. When the coupler 54 is in a hidden position, the eye 58 is positioned within the wide section 50 of the pocket 46. Moreover, when in a hidden position, the coupler 54 is fully recessed within the pocket 46 below the upper surface 18 of the beam 12.

Figure 13:
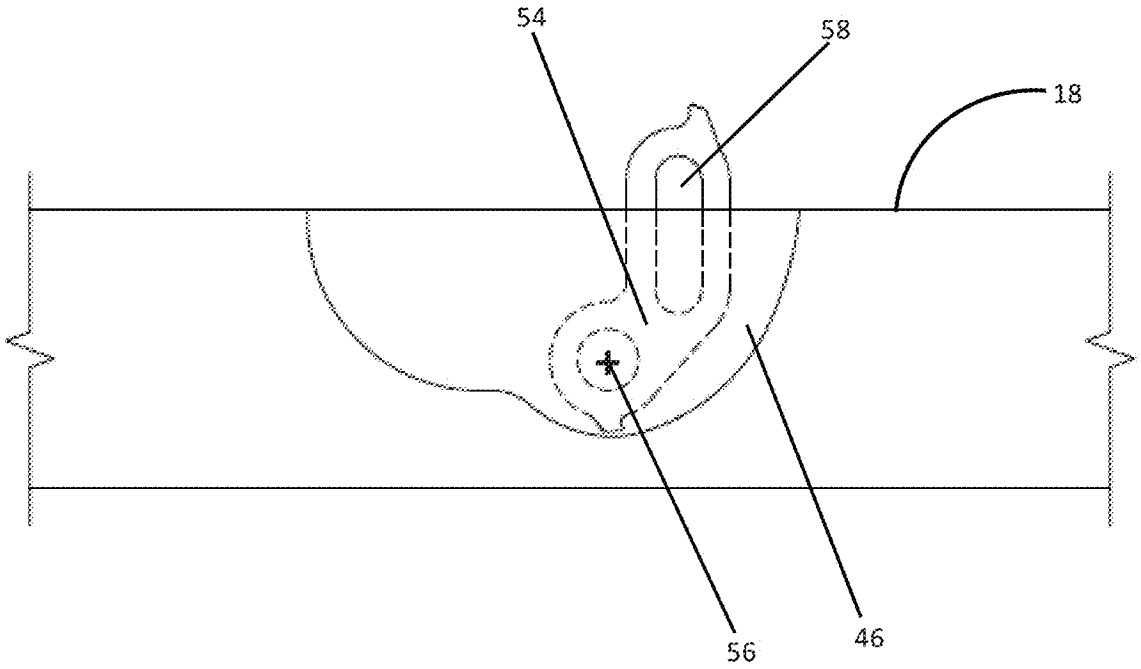
FIG. 13 is a cross-sectional view of the pocket and the coupler shown in FIG. 12, in which the coupler has been rotated to an exposed position.

In contrast, FIG. 13 shows the coupler 54 in an exposed position. When the coupler 54 is in an exposed position, at least a port on of the eye 58 projects outside the pocket 46.

The mat 10 is formed by arranging the plurality of beams 12 side-by-side so that the bores 24 are aligned. Each coupler 54 is placed into its pocket 46 such that the pivot point 56 is in line with the bore 24 passing through the pocket 46. The connectors 26 are threaded through the aligned bores 24. As the connectors 26 pass through the bores 24, each coupler 54 is threaded onto the connector 26 that passes through the coupler's pocket 46. The connectors 26 are tightened to compress the beams 12 and hold the beams 12 together.

Turning to FIGS. 5-8, the assembled mat 10 has a pair of opposed first and second sides 66, an upper side 68, a lower side 70, and a pair of opposed first and second ends 72. The mat 10 shown in FIGS. 5-8 is made of nine beams 12. However, the mat 10 may be made of any suitable number of beams 12.

Figure 6:
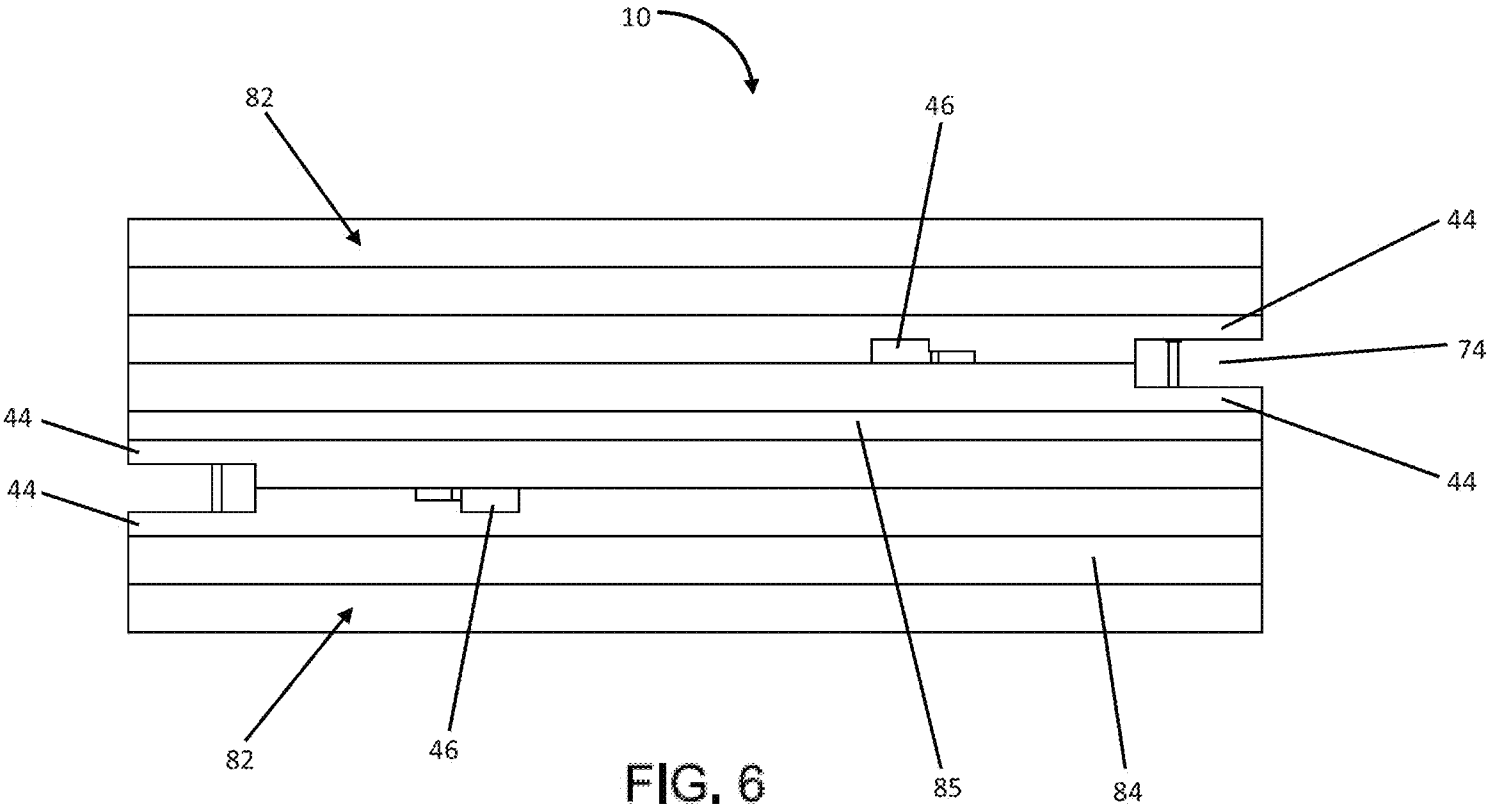
FIG. 6 is a plan view of the mat of FIG. 5.
Figure 8:
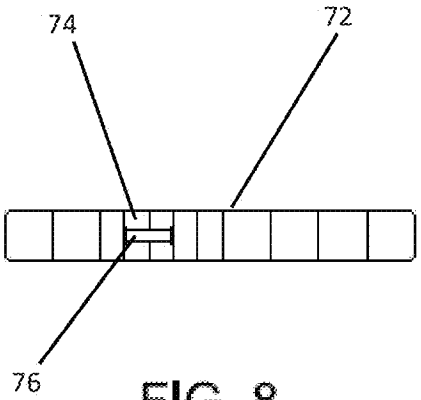
FIG. 8 is an devotional view of another end of a mat formed from the beams of FIGS. 1-3.
Figure 7:
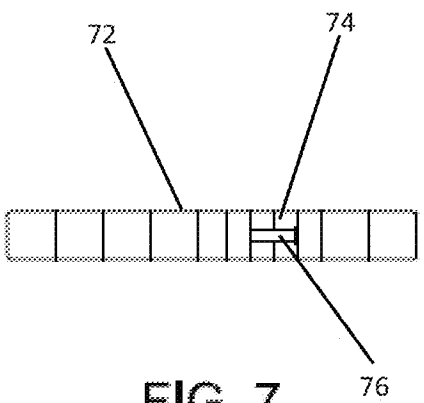
FIG. 7 is an elevational view of an end of the mat of FIG. 5.

With reference to FIGS. 5 and 6, the mat 10 is characterized by a plurality of recesses 74. Each recess 74 is formed from where notches 42 join in adjacent notched beams 44. Each of the notches 42 are contiguous with the end of the notched beam 44 within which the notch 42 is formed.

Continuing with FIGS. 5 and 6, at least one of the plurality of connectors 26 passes through each recess 74. A tool, such as a lifting hook, may be attached to the connector 26 that passes through the recess 74. The lifting hook may be connected to a hoist or other equipment suitable for moving the mat 10.

Forming the recess 74 from two notched beams 44 is advantageous because it provides ample width to accommodate the lifting tool in the recess 74 without requiring any beam 12 to be shortened across its entire width. Shortening any beam across its entire width to form the recess is undesirable because the shortened beam has fewer connectors passing through it. In the mat 10, each notched beam 44 has only a portion of its width removed so the connector 26 passing through the recess 74 also passes through both notched beams 44. When the connector 26 passes through both notched beams 44 at the recess 74, the mat 10 is strengthened.

Figure 11:
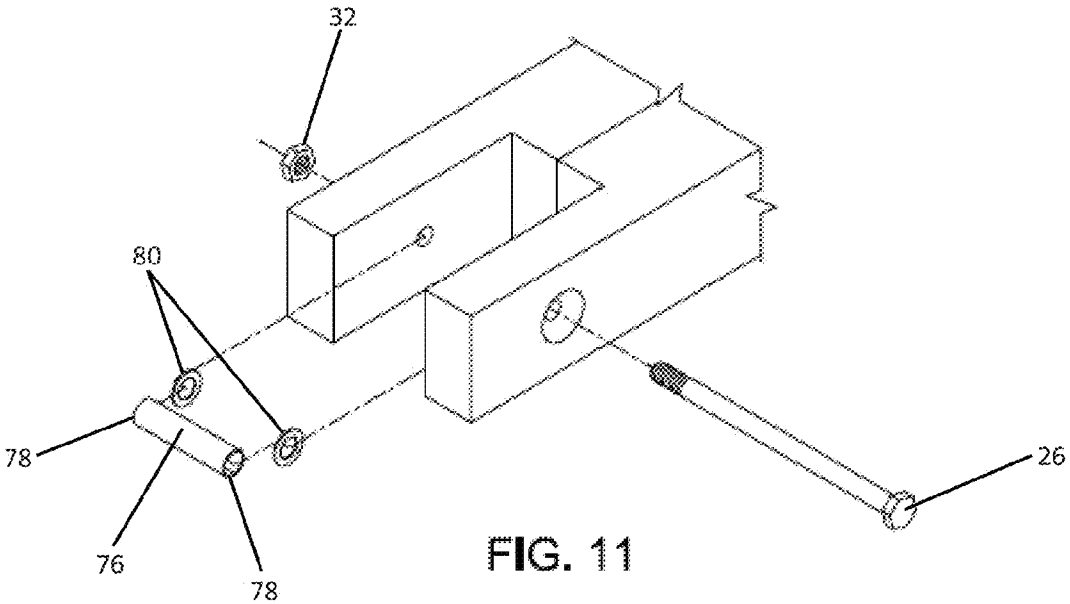
FIG. 11 is a partially exploded view of the recessed area of FIG. 10, showing a tensioning rod passing through the rigid sleeve and washers.
Figure 10:
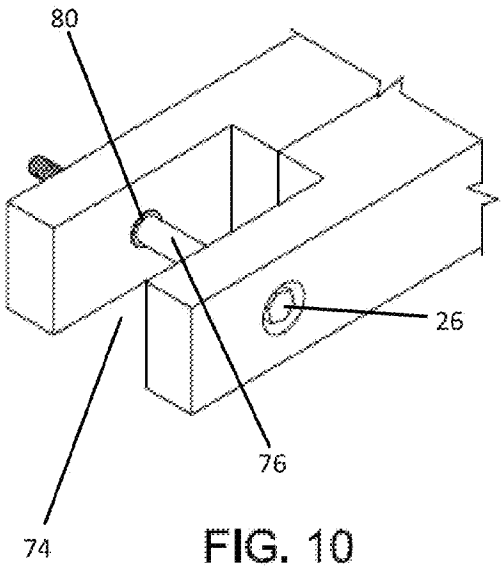
FIG. 10 is an enlarged perspective view of a rigid sleeve and a plurality of washers positioned within a recess formed in the mat of FIG. 5.

As best shown in FIGS. 10 and 11, a sleeve 76 may be positioned within the recess 74 to improve the sturdiness of the mat 10. The sleeve 76 surrounds a portion of the connector 26 disposed within the recess 74. A lifting hook may be attached to the sleeve 76.

The sleeve 76 has a pair of opposed ends 78. A plurality of washers 80 may be positioned surrounding the connector 26 proximate the ends 78 of the sleeve 76. The sleeve 76 and the plurality of washers 80 are formed from a sturdy material, such as metal or plastic. The sleeve 76 is rigid so that when the beams 12 are compressed by tightening the connector 26, the sleeve 76 strengthens the mat 10 at the recess 74. Because the sleeve 76 is rigid, it maintains its shape to prevent the beams 12 from warping inward at the recess 74 when the beams 12 are compressed.

With reference to FIGS. 5 and 6, a plurality of the pockets 46 are positioned on the upper side 68 of the mat 10. As best shown in FIG. 12, when the coupler 54 is in a hidden position, the coupler 54 is entirely recessed below the upper side 68 of the mat 10. Placing the coupler 54 in a hidden position is useful for keeping the coupler out of the way when the mat 10 is in use. Recessing the coupler 54 reduces tripping hazards and protects the coupler 54 from damage by heavy equipment driving on the mat 10. When the coupler 54 is fully recessed, there is preferably a clearance space between the coupler and the mat's upper side 68 to prevent contact between heavy equipment driving on the mat 10 and the coupler.

To use the coupler 54 for lifting the mat 10, the coupler 54 is rotated into an exposed position (FIG. 13). When the coupler 54 is in an exposed position, the eye 58 extends above the upper side 68 of the mat 10 so that the lifting hook may attach to the coupler 54 though the eye 58.

For ease in rotating the coupler 54 out of a hidden position, a user may apply a force to one or more of the levers 60 and 61. The user may use an elongate tool, such as a screwdriver, to press or pull the levers so that the coupler 54 rotates about the pivot point 56 to expose the eye 58. Alternatively, the user may access the lever 60 by putting a finger into the wide section 50 of the pocket 46 at the pocket opening 48. By pulling on the lever 60, the user can rotate the coupler 54 out of the pocket 46.

Returning to FIGS. 5 and 6, the mat 10 has a pair of opposed first and second side beams 82 situated on the opposed first and second sides 66 of the mat 10. The mat 10 has a plurality of intermediate beams 84 situated between the first and second side beams 82. The side beams 82 and the intermediate beams 84 may all be formed from the same variety of wood, such as southern yellow pine. Alternatively, the intermediate beams 84 may be formed from a different variety of wood than the side beams 82. For example, the intermediate beams 84 may be comprised of southern yellow pine, and the side beams 82 may be formed from oak. Using a strong variety of wood, such as oak, for the side beams 82 is advantageous because it strengthens the mat 10.

For additional strength, the mat 10 includes at least one intermediate beam 85 having a width that is narrower than the width of either side beam 82. For example, where the width of either side beam 82 is 5.5 inches, the narrower intermediate beam 84 may have a width of 3.5 inches.

Additionally, each side beam 82 has a plurality of edges 86 formed where the beam's opposed side surfaces 22 join the beam's upper surface 18 and lower surface 20. Each side beam 82 may have rounded outer edges to reduce the likelihood of worker injuries resulting from sharp edges and to reduce wear and tear on the mat.

Figure 9:
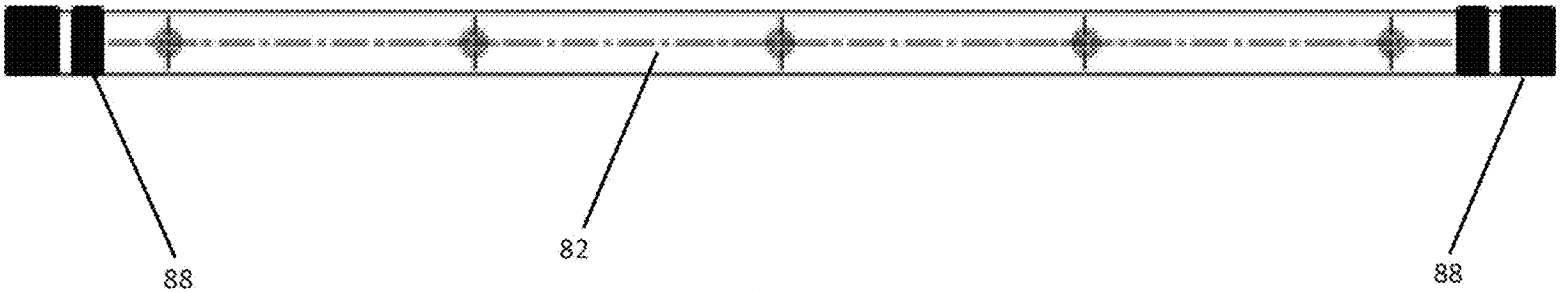
FIG. 9 is an devotional view of a side of the mat of FIG. 5.

As shown in FIG. 9, the mat 10 may have a plurality of markings 88 that are coded to provide information about the mat 10. The markings 88 may be colors, letters, numbers, or other symbols. The markings 88 may indicate such information as the name of the manufacturer, the date of manufacture, the mat type, and the variety of wood used to form the mat 10.

Figure 14:
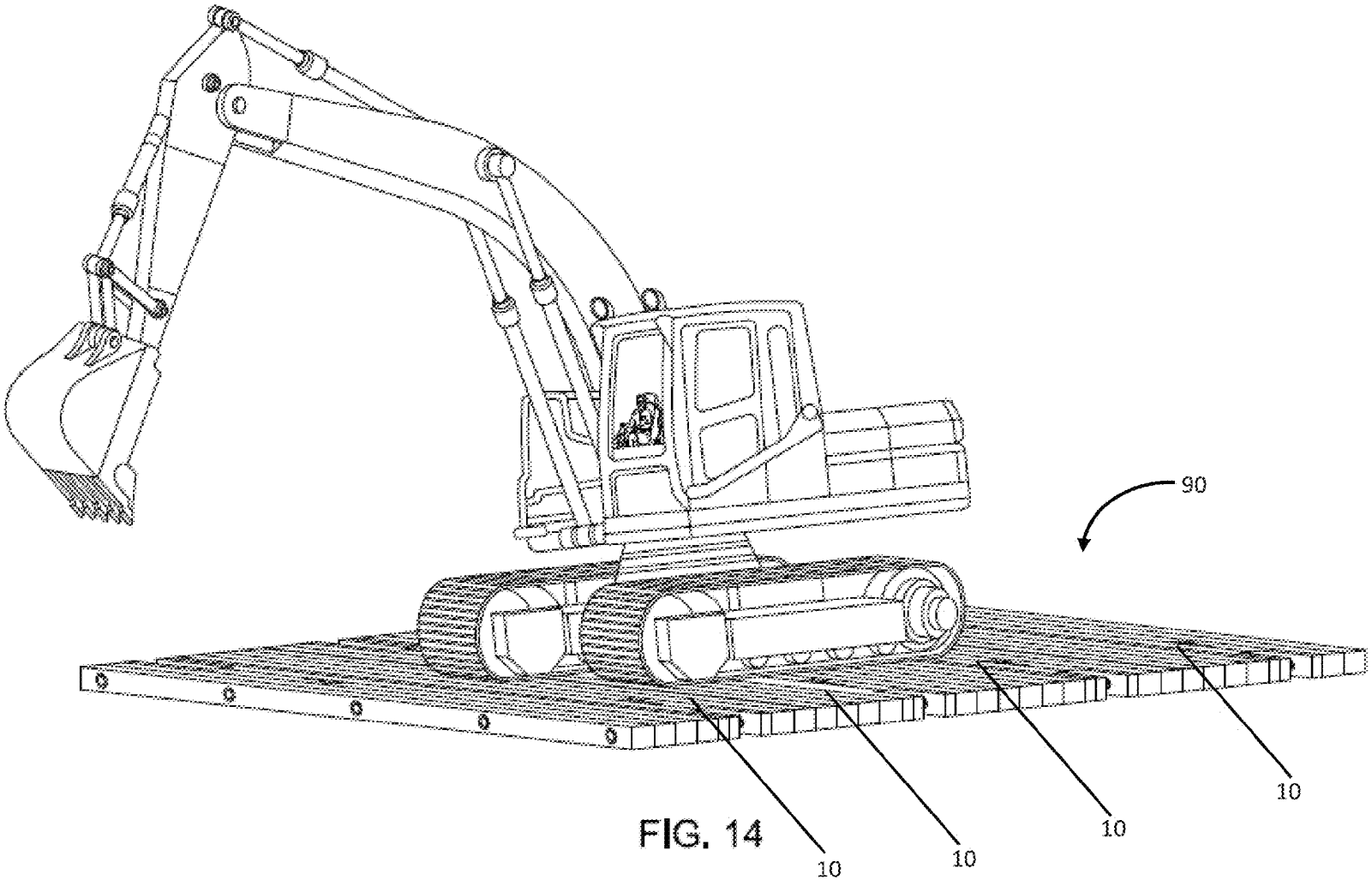
FIG. 14 is a perspective view of a flooring system formed from a plurality of the mats of FIG. 5.

With reference to FIG. 14, a plurality of mats 10 may be used to form a flooring system 90. The mats 10 are arranged adjacent one another on a surface of the ground. To move the mats 10 into place, lifting equipment may attach to the connectors 26 passing through the recesses 74 or to the sleeves 76 surrounding the connectors 26. Alternatively or additionally, the mats 10 may be moved by attaching the lifting equipment to one or more couplers 54 in the mat 10. The adjacent mats 10 arranged on the ground form a flooring system 90 for supporting heavy equipment. The flooring system 90 protects the surface of the ground and prevents the heavy equipment from getting stuck in mud or loose soil.

Changes may be made in the construction, operation and arrangement of the various parts, elements, steps and procedures described herein without departing from the spirit and scope of the invention as described in the following claims.

What is claimed is:

1. A mat, comprising:

a plurality of elongate beams arranged in side-by-side relationship, each beam having a pair of opposed side surfaces and a pair of opposed upper and lower surfaces, the plurality of elongate beams comprising a pair of adjacent notched beams, each notched beam having a notch formed in no more than a portion of its upper surface, the notches are disposed in contiguous relationship to form a recess within the mat that extends between the upper and lower surfaces of the adjacent notched beams, in which each notched beam has opposed ends, and in which each notch is contiguous with one of the ends of the notched beam within which it is formed;

a plurality of elongate connectors, each connector extending transversely through each of the plurality of beams; and a plurality of releasable tighteners, each tightener configured to control the fit between adjacent beams forming the mat.

2. The mat of claim 1 in which a width of each notch is one-half a width of the notched beam in which the notch is formed.

3. The mat of claim 1, in which at least two of the beams have a pocket formed therein, each pocket is situated on the upper side of the mat.

4. The mat of claim 3, further comprising:

a pair of rotatable couplers, each coupler situated within one of the pockets, each coupler having a pivot point, an eye, and a lever.

5. The mat of claim 4 in which the eye is formed on one side of the pivot point and the lever is situated on the opposite side of the pivot point.

6. The mat of claim 4 in which the lever is finger-accessible from a pocket opening.

7. A mat having a pair of opposed first and second sides and a pair of opposed upper and lower sides, comprising:

a plurality of elongate beams arranged in side-by-side relationship, in which the plurality of elongate beams comprise a pair of adjacent notched beams, each notched beam has a notch formed in no more than a portion of its upper surface, and the notches are disposed in contiguous relationship to form a recess within the mat, each notch has a width that is one-half a width of the notched beam in which the notch is formed;

at least five elongate connectors, each connector extending transversely through each beam and having opposed first and second ends;

a plurality of releaseable tighteners, at least one of the plurality of releaseable tighteners positioned at each of the first and second ends of the elongate connectors and configured to control the fit between adjacent beams forming the mat;

a pair of rotatable couplers are situated on the upper side of the mat, each coupler having a pivot point, an eye, and a lever, wherein the eye is formed on one side of the pivot point and the lever is situated on the opposite side of the pivot point.

8. The mat of claim 7 in which each coupler is characterized by a retracted position in which the coupler is fully contained below the upper surface of the mat, and an extended position in which the eye projects above the upper surface of the mat.

9. The mat of claim 7 in which at least one connector extends through the contiguous notches of the adjacent notched beams.

10. The mat of claim 9 in which a rigid sleeve is positioned within the notches and surrounding the at least one connector.

11. The mat of claim 7 in which the plurality of elongate beams further comprise:

wooden first and second side beams situated on the first and second sides of the mat; and one or more wooden intermediate beams situated between the first and second side beams, the intermediate beams formed from a different variety of wood than the side beams.

12. The mat of claim 7 in which the plurality of elongate beams further comprise:

first and second side beams situated on the first and second sides of the mat; and a plurality of intermediate beams situated between the first and second side beams, at least one of the intermediate beams having a width that is narrower than the width of either side beam.

* * * * *